US010317055B2

(12) United States Patent
Siepel et al.

(10) Patent No.: US 10,317,055 B2
(45) Date of Patent: Jun. 11, 2019

(54) LIGHTING DEVICE WITH CHANGING ILLUMINATION BASED ON LIGHTING DEVICE CONFIGURATION

(71) Applicant: SIGNIFY HOLDING B.V., Eindhoven (NL)

(72) Inventors: Anika Nelleke Siepel, Eindhoven (NL); Marjolein Dimmie van der Zwaag, Eindhoven (NL); Anthonie Hendrik Bergman, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 44 days.

(21) Appl. No.: 15/509,563

(22) PCT Filed: Sep. 10, 2015

(86) PCT No.: PCT/EP2015/070768
§ 371 (c)(1),
(2) Date: Mar. 8, 2017

(87) PCT Pub. No.: WO2016/038163
PCT Pub. Date: Mar. 17, 2016

(65) Prior Publication Data

US 2017/0254520 A1 Sep. 7, 2017

(30) Foreign Application Priority Data

Sep. 12, 2014 (EP) ..... 14184643

(51) Int. Cl.
*F21V 21/14* (2006.01)
*F21V 3/02* (2006.01)
(Continued)

(52) U.S. Cl.
CPC ..... *F21V 21/14* (2013.01); *F21S 4/24* (2016.01); *F21V 3/02* (2013.01); *F21V 23/003* (2013.01);
(Continued)

(58) Field of Classification Search
CPC . A63H 33/22; A63H 1/24; F21S 6/001; F21S 6/002; F21S 6/004; F21S 10/04;
(Continued)

(56) References Cited

U.S. PATENT DOCUMENTS 7,347,578 B1 * 3/2008 Nourse ..... A41D 19/0157 2/159
2005/0087702 A1 * 4/2005 Ford ..... F21L 4/02 250/504 R
(Continued)

FOREIGN PATENT DOCUMENTS

DE 202013008293 U1 11/2012

OTHER PUBLICATIONS

Machine translation of DE 20 2012 008293 U1, retrieved Aug. 6, 2018.*

*Primary Examiner* — Anh T Mai
*Assistant Examiner* — Steven Y Horikoshi
(74) *Attorney, Agent, or Firm* — Akarsh P. Belagodu

(57) ABSTRACT

A lighting device (1) is provided. The light device (1) comprises a first part (2) and a second part (2) which is flexibly connected to the first part (2) so that the lighting device (1) can be in at least two configurations. There is a sensor (7) which detects the configuration of the lighting device (1) and a controller for receiving the sensor signal from the sensor (7) and for providing an output to first light sources and second light sources.

11 Claims, 5 Drawing Sheets

(51) Int. Cl.

| | |
|---|---|
| ***F21V 23/00*** | (2015.01) |
| ***F21V 23/04*** | (2006.01) |
| ***F21S 4/24*** | (2016.01) |
| ***H05B 33/08*** | (2006.01) |
| *F21V 31/00* | (2006.01) |
| *F21Y 115/10* | (2016.01) |
| *F21Y 113/13* | (2016.01) |
| *F21Y 103/00* | (2016.01) |

(52) U.S. Cl.
CPC ..... *F21V 23/0442* (2013.01); *F21V 23/0492* (2013.01); *H05B 33/0854* (2013.01); *H05B 33/0872* (2013.01); *F21V 31/00* (2013.01); *F21Y 2103/00* (2013.01); *F21Y 2113/13* (2016.08); *F21Y 2115/10* (2016.08)

(58) Field of Classification Search
CPC ..... F21S 10/043; F21S 10/046; F21S 10/02–10/026; F21V 21/14; F21V 21/32; F21V 23/0442; F21V 23/0492; F21V 2200/00–2200/17; F21V 2200/40; F21V 1/06; F21V 1/08; F21V 1/12; F21V 1/20; F21V 1/22; F21V 14/02; H05B 33/0854; H05B 33/0872; F21Y 2107/70; F21Y 2107/80; G02B 6/001
See application file for complete search history.

(56) References Cited

U.S. PATENT DOCUMENTS

| | | | |
|---|---|---|---|
| 2013/0225037 | A1 | 8/2013 | Deluz |
| 2013/0249435 | A1 | 9/2013 | Hellkamp |

* cited by examiner

LIGHTING DEVICE WITH CHANGING ILLUMINATION BASED ON LIGHTING DEVICE CONFIGURATION

CROSS-REFERENCE TO PRIOR APPLICATIONS

This application is the U.S. National Phase application under 35 U.S.C. § 371 of International Application No. PCT/EP2015/070768, filed on Sep. 10, 2015, which claims the benefit of European Patent Application No. 14184643.6, filed on Sep. 12, 2014. These applications are hereby incorporated by reference herein.

FIELD OF THE INVENTION

The invention relates to the field of lighting devices and more specifically to configurable lighting devices.

SUMMARY OF THE INVENTION

It would be advantageous to provide a lighting device that has a variable configuration, it would also be desirable to enable a user to adjust the variable configuration of the lighting device. To better address one or more of these concerns, in a first aspect of the invention a lighting device is presented that comprises;

a first part, a second part which is flexibly connected to the first part so that the lighting device can be in at least two configurations, a sensor for detecting the configuration of the lighting device, each of the first and second parts comprises a first and a second light source, the first light source is for emitting light in a first direction and the second light source is for emitting light in a second direction different to the first direction, and a controller for controlling the light sources, and wherein the sensor output is fed to the controller, and based on the sensor output the controller selectively powers either the first light sources, second light sources or a combination of the first and second light sources.

A method of controlling the lighting device is also provided.

These and other aspects of the invention will be apparent from and elucidated with reference to the embodiment(s) described hereinafter.

BRIEF DESCRIPTION OF THE DRAWINGS

Examples of the invention will now be described in detail with reference to the accompanying drawings, in which.

DETAILED DESCRIPTION OF EMBODIMENTS

Figure 1:
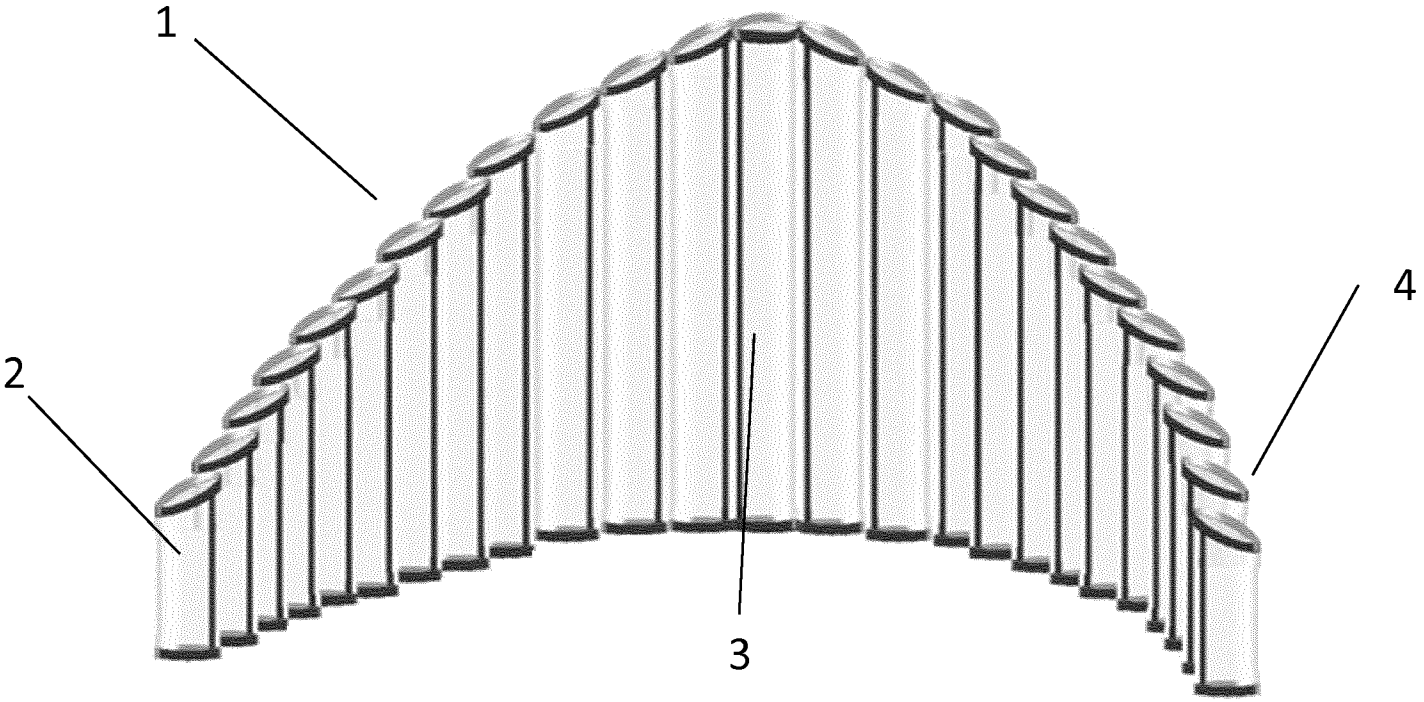
FIG. 1 shows an embodiment of a lighting device in a minimally curved configuration.

FIG. 1 shows an embodiment of a lighting device 1. In this embodiment the first and second parts comprise tubes 2.

The lighting device 1 has an inner surface 3 for emitting light and an outer surface 4 for emitting light. A light source (not shown), a sensor (not shown), and a controller (not shown) are provided to emit light of a desired color, color temperature or intensity based on the sensor output which in turn is based on the configuration of the lighting device 1.

Figure 2:
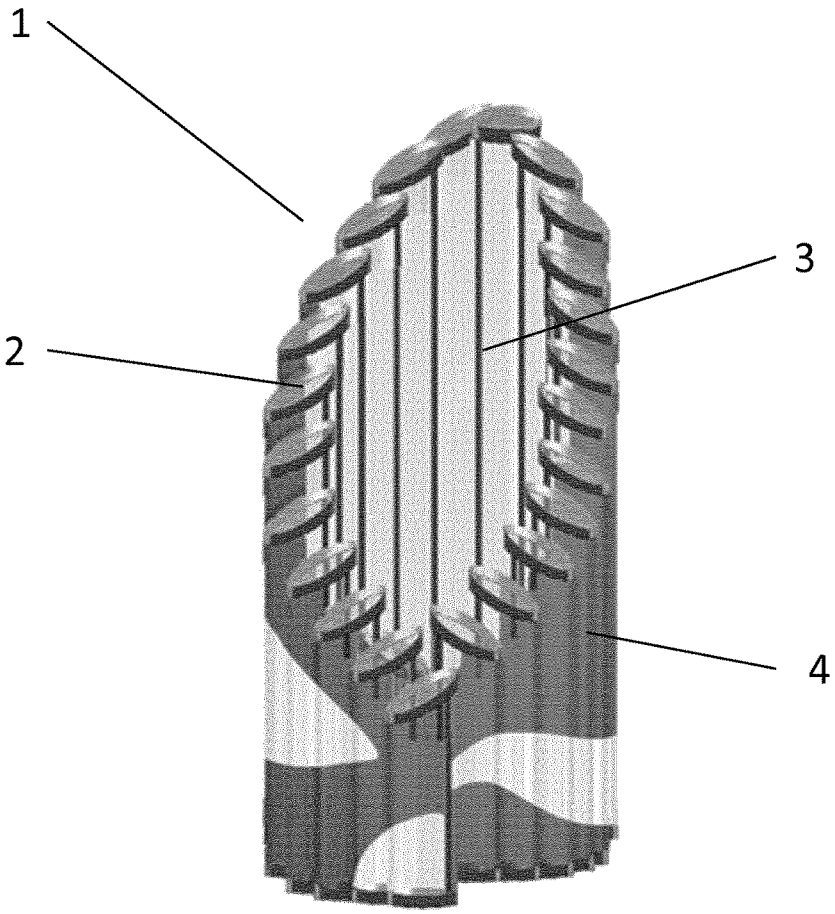
FIG. 2 shows an embodiment of a lighting device in a curved configuration.

FIG. 2 shows an embodiment of a lighting device 1 in a curved configuration. This curvature may be configured by the user of the lamp. It can be seen from the figure that the lighting device 1 has been curved around so that the ends of the lighting device overlap. The intensity, color or color temperature of the light emitted by the first light sources through the inner surface 3 may be adjusted by the controller based on the configuration of the lighting device 1 that the user has configured. The intensity, color or color temperature of the light emitted by the second light sources through the outer surface 4 of the lighting device 1 may also be adjusted by the controller based on the configuration of the lighting device 1 that the user has configured. This adjustment of the light emitted by the second light sources through the outer surface 4 may be carried out simultaneously with an adjustment of the light emitted by the first light sources through the inner surface 3, it may be separate or the adjustments may overlap. The first light sources and the second light sources may emit light in a pattern controlled by the controller.

Figure 3:
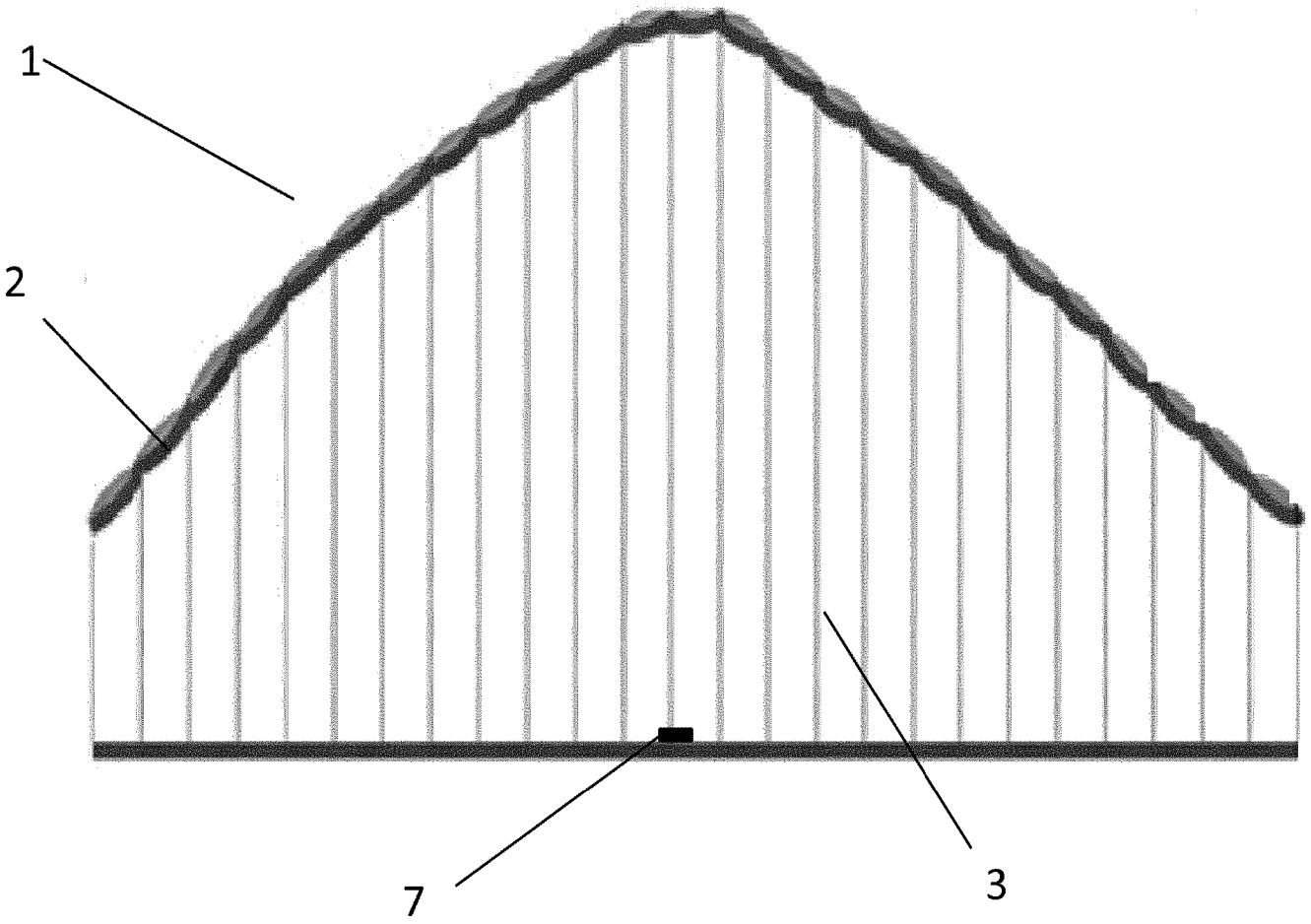
FIG. 3 shows an embodiment of a lighting device in a linear configuration.

FIG. 3 shows an embodiment of a lighting device 1 in a linear configuration. The inner surface 3 may emit light of a desired intensity, color or colour temperature. A sensor 7 detects the configuration of the lighting device 1. A sensor that may be suitable for detecting the configuration of the lighting device 1 is a strain gauge.

A common type of strain gauge consists of an insulated backing which supports a metallic foil pattern. The gauge is attached between the first part and the second part of the lighting device 1 by a suitable adhesive, such as cyanoacrylate. As the parts are configured, the foil is deformed, causing its electrical resistance to change.

A strain gauge takes advantage of the physical property of electrical conductance and its dependence on the conductor's geometry. When an electrical conductor is stretched within the limits of its elasticity such that it does not break or permanently deform, it will become narrower and longer, these are changes that increase its electrical resistance end-to-end. Conversely, when a conductor is compressed such that it does not buckle, it will broaden and shorten; these are changes that decrease its electrical resistance end-to-end. From the measured electrical resistance of the strain gauge, the amount of applied stress may be inferred.

A typical strain gauge arranges a long, thin conductive strip in a zig-zag pattern of parallel lines such that a small amount of stress in the direction of the orientation of the parallel lines results in a magnified strain measurement over the effective length of the conductor surfaces in the array of conductive lines; and thus a magnified change in resistance, than would be observed with a single straight-line conductive wire.

An excitation voltage is applied to input leads of the gauge network, This voltage can be provided by the controller within the lighting device 1 or it may be a separate internal or external voltage source, such as for example a battery. Once the voltage is applied to the input, a voltage reading is taken from the output leads. Typical input voltages are 5 V or 12 V and typical output readings are in millivolts.

Foil strain gauges are used in many situations. Different applications place different requirements on the gauge. In most cases the orientation of the strain gauge is significant.

Gauges attached to a load cell would normally be expected to remain stable over a period of years, if not decades; while those used to measure response in a dynamic experiment may only need to remain attached to the object for a few days, be energized for less than an hour, and operate for less than a second. The lifetime of the strain gauge within the lighting device 1 should be comparable to the lifetime of the first and second light sources.

Strain gauges are attached to the substrate with glue. The type of glue depends on the required lifetime of the measurement system. For short term measurements (up to some weeks) cyanoacrylic glue is appropriate, for long lasting installation epoxy glue is required. Usually epoxy glue requires high temperature curing (at about 80-100° C.). The preparation of the surface where the strain gauge is to be glued is of the utmost importance. The surface must be smoothed (e.g. with very fine sand paper), de-oiled with solvents, the solvent traces must then be removed and the strain gauge must be glued immediately after this to avoid oxidation or pollution of the prepared area. If these steps are not followed the strain gauge binding to the surface may be unreliable and unpredictable measurement errors may be generated.

Capacitive strain gauges use a variable capacitor to indicate the level of mechanical deformation For measurements of small strain, semiconductor strain gauges, so called piezoresistors, are often preferred over foil gauges. A semiconductor gauge usually has a larger gauge factor than a foil gauge. Semiconductor gauges tend to be more expensive, more sensitive to temperature changes, and are more fragile than foil gauges.

Nanoparticle-based strain gauges are emerging as a new promising technology. These resistive sensors whose active area is made by an assembly of conductive gold nanoparticles combine a high gauge factor, a large deformation range and a small electrical consumption due to their high impedance.

Another way of detecting the curvature of the lighting device is 1 to use optical sensors 7 utilising time of flight measurements. If at least three sensors 7 are used, one at each end of the lighting device 1 and the third in the centre, it is possible to calculate the relative positions of the ends of the lighting device 1 compared with the centre using the principle of triangulation. This is possible because the positions of the sensors 7 are known when the lighting device 1 is manufactured and so if calibrated correctly, i.e. when the lighting device 1 is in a known position and the distances between the sensors 7 can be accurately measured the system can prove to be robust.

An embodiment of the first and second light sources utilizes LED strips. An LED Strip Light (also known as an LED tape or ribbon light) is a flexible strip of surface mounted light-emitting diodes that usually comes with an adhesive backing. This allows for swift and secure location during manufacturing, obviously other fixing methods as known to the person skilled in the art may be employed instead.

The LED strip may be produced with different characteristics, i.e, intensity, color temperature or indeed full RGB color changing. The LED strip may be provided with an individual control chip located next to each LED, or one chip is provided per strip in each of the plurality of parts within the multi-part luminaire, or it may be that the control of the LEDs is provided solely by the main controller within the multi-part luminaire. Any combination that proves advantageous may be utilised too.

The most simple type of LED strip is a single color, non-addressable LED strip. Every LED in the strip is a single white colour, typically ranging from 2700K to 6500K in colour temperature.

A single chip address all of the LEDs in the strand at once so each setting is applied to every LED.

A RGB, non-addressable LED strip is more complex, the RGB LEDS can output multiple colors but the entire strand uses the same address so all LEDs within that strip show the same color.

Addressable LED strips have an individual chip per LED, these allow tuning of intensity and/or color temperature per LED in the case of white LEDs or full color control and/or intensity per RGB LED.

Further light effects such as chasing or strobing etc are possible as each LED is controlled by a dedicated chip.

The lighting device 1 may be suitable for use in an external environment such as, for example, a garden. This can be achieved by using a water resistant LED light strip. Water resistant LED strips are covered in a heat conducting epoxy to protect the circuitry from direct contact with water.

The LED strips typically operate on 12 or 24 volts of direct current provided in this case by the controller. USB strip lights operate on the standard 5-volt direct current used by USB devices.

The user may configure the curvature of the lighting device 1 in order to fulfil aesthetic requirements or the tailoring of the light output. When the lighting device 1 has a minimum curvature, i.e. when it is substantially linear, the inner surface 3 of the lighting device 1 may transmit light with a higher intensity than when the curvature is more pronounced. The controller within the lighting device 1 may be configured to adjust a property of the light emitted by the first light sources and/or the second light sources based on the output from the sensor 7. The sensor 7 detects the configuration of the lighting device 1 and outputs a sensor signal, for example, a voltage based on the amount of curvature sensed.

The controller receives this sensor signal and then calculates the required light properties based on a predetermined algorithm. The controller may increase the intensity of the light emitted by the first light sources as the lighting device 1 is uncurled by the user. The controller may alternatively decrease the intensity of the light emitted by the first light sources as the user uncurls the lighting device 1.

In a further embodiment, the first light sources may comprise RGB LEDs, the color may be changed by the controller based on the configuration of the lighting device 1. For example, the RGB LEDs may emit a red light once a predetermined curvature has been exceeded, that is to say, if the user straightens the lighting device, once a certain minimum curvature threshold has been reached, the RGB LEDs may be controlled to emit red light.

In a further embodiment, the RGB LEDs may be controlled to start producing a light effect, for example a rolling change of color when a predetermined minimum curvature threshold has been exceeded. The RGB light sources up until this minimum curvature may have been emitting white light. Alternatively, the colour effect may be emitted until the minimum curvature threshold has been reached and then, when exceeded, the first light sources may emit white light.

In a yet further embodiment, the second light sources may be controlled to change the light intensity and/or light color emitted by the second light source. This may be based, as for the first light sources, on a change in the configuration of the lighting device 1, for example, a curvature of the lighting device 1 that has been adjusted by the user.

In a further embodiment the controller may be configured to reduce the intensity of the light emitted by the second light sources and to simultaneously control the first light sources to emit white light once a predetermined minimum curvature threshold has been exceeded. This may prove advantageous in both reducing the electrical load drawn by the lighting device 1 or in decreasing the thermal load generated by the combination of the first light sources and the second light sources. This may be an advantage when the plurality of parts within the lighting device 1 reduce in size, or it may bring economic benefits as smaller heat sinks for the LEDs may be required.

In a further embodiment, the controller may progressively increase the intensity of the white light emitted by the first light sources based on a decrease in the curvature of the luminaire once a predetermined minimum curvature threshold has been reached.

Figure 4:
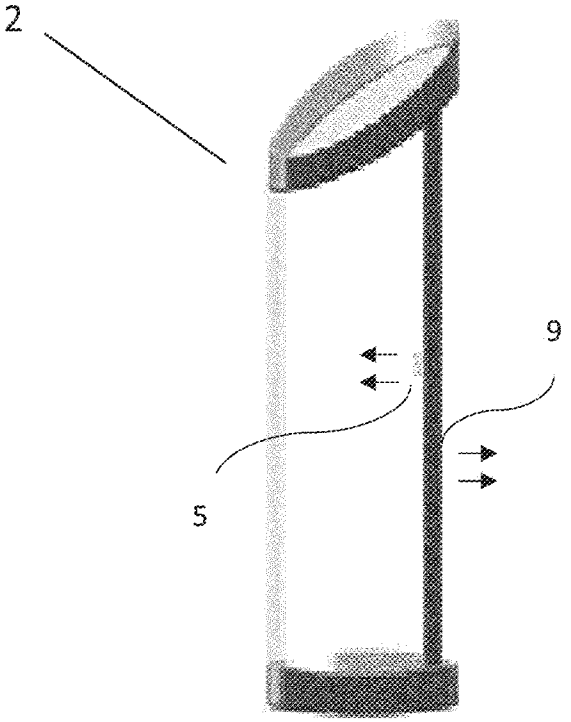
FIG. 4 shows an embodiment of a tube that may be used in a lighting device.

FIG. 4 shows an embodiment of a tube 2 that may be used in a lighting device 1. The first and second parts comprise of tubes 2. These tubes 2 may comprise at least a portion of their surface area being diffusely transmissive. The tubes 2 may be arranged in a vertical orientation with first light sources 5 and second light sources 9 being housed inside each tube 2.

The tubes 2 may be flexibly joined along their length to one another to enable a user configurable lighting device 1 to be manufactured. The tubes 2 may be all the same length or they may vary in length. A variation of length of tubes 2 may prove to be an aesthetic advantage. The variation may be symmetrical around the vertical axis located at the midpoint of the lighting device 1, it may be asymmetric or it may be random or any other pattern that is desired.

Figure 5:
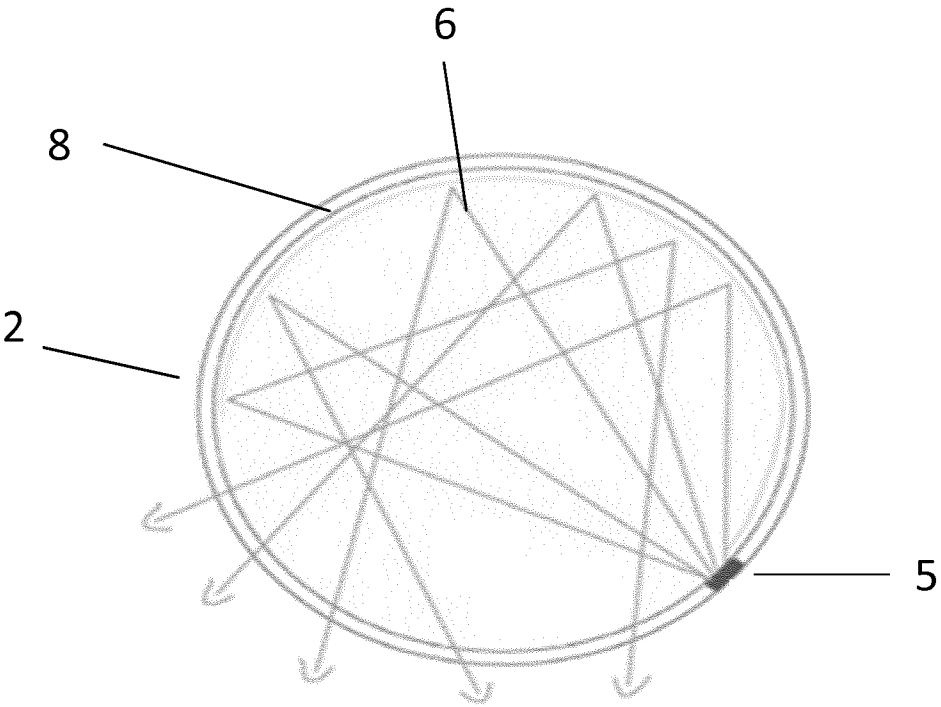
FIG. 5 shows a visualisation of a ray trace of light emitted by a first light source located within a tube that may be used in a lighting device.

FIG. 5 shows a visualisation of a ray trace 6 of light emitted by a first light source 5 located within a tube 2 that may be used in a lighting device 1. The first light source 5 emits light along an optical axis towards the wall 8 of the tube 2 opposite the first light source. The ray trace of the second light source and the second light source itself are not shown in the interests of clarity.

While the invention has been illustrated and described in detail in the drawings and foregoing description, such illustration and description are to be considered illustrative or exemplary and not restrictive; the invention is not limited to the disclosed embodiments.

The invention claimed is:

1. A lighting device comprising;

a first tubular part, a second tubular part flexibly connected to the first tubular part so that the lighting device is configurable in at least two configurations, a sensor for detecting the configuration of the lighting device, wherein each of the first and second tubular parts comprises a first light source and a second light source, the first light source being configured to emit light in a first direction and the second light source being configured to emit light in a second direction different from the first direction, and a controller for controlling the first and second light sources, wherein an output of the sensor is fed to the controller, and wherein, based on the output, the controller selectively powers either the first light source, the second light source, or a combination of the first and second light sources.

2. The lighting device according to claim 1, wherein each of the first and second light sources comprises multiple RGB LEDs.

3. The lighting device according to claim 1, wherein the sensor comprises a strain gauge.

4. The lighting device according to claim 1, wherein the second direction is opposite to the first direction.

5. The lighting device of claim 1, wherein the sensor comprises a plurality of optical sensors.

6. The lighting device of claim 5, wherein the output of the sensor includes time of flight measurements in accordance with relative positions of the optical sensors.

7. The lighting device of claim 1, wherein the first light source emits light through an inner surface of each of the first and second tubular parts.

8. The lighting device of claim 1, wherein the second light source emits light through an outer surface of each of the first and second tubular parts.

9. The lighting device of claim 1, wherein at least a portion of a surface of the first and second tubular parts is diffusely transmissive.

10. A lighting device comprising:

a first part, a second part flexibly connected to the first part so that the lighting device is configurable in at least two configurations, a sensor for detecting the configuration of the lighting device, wherein each of the first and second parts comprises a first light source and a second light source, the first light source being configured to emit light in a first direction and the second light source being configured to emit light in a second direction different from the first direction, and a controller for controlling the first and second light sources, wherein an output of the sensor is fed to the controller, wherein, based on the output, the controller selectively powers either the first light source, the second light source, or a combination of the first and second light sources, wherein the first and second parts are tubes, and wherein for each of the tubes at least a portion of its surface area is diffusely transmissive.

11. A method of controlling a lighting device, the lighting device comprising a first tubular part, a second tubular part flexibly connected to the first tubular part so that the lighting device is configurable in at least two configurations, a sensor for detecting the configuration of the lighting device, wherein each of the first and second tubular parts comprises a first light source and a second light source, the first light source being configured to emit light in a first direction and the second light source being configured to emit light in a second direction different to the first direction, and a controller for controlling the first and second light sources, the method comprising:

outputting a sensor signal from the sensor to the controller, the sensor signal being indicative of the configuration of the lighting device, calculating a light property based on the sensor signal, outputting a control signal from the controller to one or more of the first and second light sources to vary properties of the light emitted by the first and second light sources.

* * * * *